US007857105B2

(12) United States Patent
Roydhouse

(10) Patent No.: US 7,857,105 B2
(45) Date of Patent: Dec. 28, 2010

(54) SYSTEM AND METHOD FOR FORMING INFORMATION PERTAINING TO A TRANSPORTATION DEVICE

(75) Inventor: Oliver Roydhouse, Melbourne (AU)

(73) Assignee: Inlink Technologies Pty Ltd, South Melbourne, Victoria (AU)

( * ) Notice: Subject to any disclaimer, the term of this patent is extended or adjusted under 35 U.S.C. 154(b) by 586 days.

(21) Appl. No.: 10/579,824

(22) PCT Filed: Oct. 15, 2004

(86) PCT No.: PCT/AU2004/001418

§ 371 (c)(1),
(2), (4) Date: May 16, 2007

(87) PCT Pub. No.: WO2005/047158

PCT Pub. Date: May 26, 2005

(65) Prior Publication Data

US 2007/0295565 A1 Dec. 27, 2007

(30) Foreign Application Priority Data

Nov. 17, 2003 (AU) ..... 2003906333
Mar. 31, 2004 (AU) ..... 2004901734

(51) Int. Cl.
*B66B 1/34* (2006.01)

(52) U.S. Cl. ..... 187/391; 187/247

(58) Field of Classification Search ..... 187/380–389, 187/391–396, 247
See application file for complete search history.

(56) References Cited

U.S. PATENT DOCUMENTS

| | | | | |
|---|---|---|---|---|
| 4,568,909 | A * | 2/1986 | Whynacht | 187/393 |
| 4,698,780 | A * | 10/1987 | Mandel et al. | 187/393 |
| 5,557,546 | A * | 9/1996 | Fukai et al. | 702/185 |
| 6,202,799 | B1 * | 3/2001 | Drop | 187/388 |
| 6,330,935 | B1 * | 12/2001 | Systermans | 187/391 |
| 6,416,923 | B2 * | 7/2002 | Miyazaki | 430/200 |
| 7,319,966 | B2 * | 1/2008 | Friedli et al. | 705/1 |
| 7,419,032 | B2 * | 9/2008 | Yamakawa | 187/247 |

FOREIGN PATENT DOCUMENTS

| | | |
|---|---|---|
| JP | 9-67072 | 3/1997 |
| JP | 2002-128407 | 5/2002 |
| JP | 2003-238040 | 8/2003 |
| WO | WO 03/058579 A1 | 7/2003 |

* cited by examiner

*Primary Examiner*—Jonathan Salata
(74) *Attorney, Agent, or Firm*—Jones Day

(57) ABSTRACT

The present invention relates to a system for forming information pertaining to a transportation device, such as an elevator. Audio visual information of the contents of an elevator, such as a person using the elevator, is captured and transmitted to a remote computing system. The status of the elevator, such as position between floors, is also captured and transmitted to the computing system. The elevator status and video/audio information are date/time stamped so that they can subsequently be searched to determine the status of the elevator when particular audio/visual information was captured, and vice versa.

33 Claims, 2 Drawing Sheets

SYSTEM AND METHOD FOR FORMING INFORMATION PERTAINING TO A TRANSPORTATION DEVICE

CROSS REFERENCE TO RELATED APPLICATION

This application is the National Phase application of International Application No. PCT/AU2004/001418, filed Oct. 15, 2004, which designates the United States and was published in English. This application, in its entirety, is incorporated herein by reference.

FIELD OF THE INVENTION

The present invention relates generally to a system and method for forming information pertaining to a transportation device and has particular—but by no means exclusive—application to forming information comprising audiovisual information, status information about the transportation device, and personal information about a user of the transportation device.

BACKGROUND OF THE INVENTION

Collecting information pertaining to a transportation device (such as an elevator, escalator or moving walkway) is desirable for several reasons. For example, collecting audiovisual information concerning occupants of the elevator is particularly useful for security and safety systems. More specifically, being able to collect video footage of the occupants inside the elevator enables security officers to identify occupants who may, for instance, vandalise the passenger area of the elevator. The ability to collect audio information from the occupants of the elevator enables, for example, an emergency call centre operator to communicate with the occupants when the elevator unexpectedly breaks down trapping occupants therein. Other information relating to the elevator that may be desirable to collect includes information pertaining to the status of the elevator. For example, status information would typically allow a maintenance engineer to readily determine the status of the elevator, such as the floor at which the elevator is located or any faults identified with the elevator system. Additionally, personal information relating to the users of a transportation device can be particularly useful for security systems and would enable security officers to determine which users are using (or have used) the transportation device at any particular time and/or to store a history of usage for future reference.

SUMMARY OF THE INVENTION

According to a first aspect of the present invention, there is provided a system for forming information pertaining to a transportation device, the system comprising:

obtaining means arranged to obtain first information that is related to a person using the transportation device, and second information about a status of the transportation device; and associating means arranged to create an association between the first information and the second information to thereby form the information pertaining to the transportation device.

Thus, the association enables an entity to readily determine the second information that is associated with the first information, or visa versa.

Preferably, the obtaining means is arranged to obtain the first information and the second information from an information capture system that is remote to the obtaining means.

Alternatively, the information capture system is part of the obtaining means.

Preferably, the obtaining means comprises a communications interface arranged such that the obtaining means can obtain the first information and the second information from the information capture system.

Preferably, the communication interface is arranged to communicate with the information capture system using Ethernet.

Alternatively, the communication interface is arranged to communicate with the information capture system using other communication technologies; for example, fibre optic communication.

Preferably, the associating means is arranged to create the association by assigning first data to the first information and second data to the second information, wherein the first data and the second data correspond substantially with each other.

Alternatively, the associating means is arranged to create the association by inserting the second information into the first information.

Preferably, the first data and the second data each comprise a time and/or date stamp.

Alternatively, the first data and the second data each comprise a tag or identifier that is made up of a series of selected numerals and/or letters.

Preferably, the system further comprises a storage means arranged to store the first information, second information, and the association.

Preferably, the storage means comprises a database.

Alternatively, the storage means comprises a storage medium such as a CD-ROM or hard disk.

Preferably, the system further comprises access means arranged such that an entity can access the first information, second information and the association when stored in the storage means.

Preferably, the access means is arranged such that the entity can access the first information, second information and the association from a device remote to the storage means.

Alternatively, the access means is arranged to enable the device to have local access to the storage means.

Preferably, the access means is arranged to communicate with the device via an Internet.

Preferably, the first information comprises video and/or audio information, and the second information comprises a status and mode of the transportation device, and fault related data.

Preferably, the first information further comprises security related information.

Preferably, the security related information comprises personal information.

Preferably, the obtaining means is arranged to obtain the security related information from an access control system.

Preferably, the security related information comprises an identifier of a person.

Preferably, the associating means is further arranged to create an association between the security related information and the video and/or audio information.

Preferably, the transportation device comprises an elevator, escalator or a moving walkway.

Preferably, the second information comprises a direction, floor position and door status of the elevator.

According to a second aspect of the present invention, there is provided a method of forming information pertaining to a transportation device, the method comprising the steps of:

obtaining first information that is related to a person using the transportation device, and second information about a status of the transportation device; and creating an association between the first information and the second information to thereby form the information pertaining to the transportation device.

Preferably, the step of obtaining the first information and the second information comprises the step of obtaining the first information and the second information from a remote information capture system.

Preferably, the step of obtaining the first information and the second information comprises the step of using a communications interface to obtain the first information and the second information from the information capture system.

Preferably, the communication interface is arranged to communicate with the information capture system using Ethernet.

Preferably, the step of creating the association comprises the step of creating the association by assigning first data to the first information and second data to the second information, wherein the first data and the second data correspond substantially with each other.

Preferably, the first data and the second data each comprise a time and/or date stamp.

Preferably, the method further comprises the step of storing the first information, second information and the association in a storage means.

Preferably, the storage means comprises a database.

Preferably, the method further comprises the step of remotely accessing the first information, second information and the association in the storage means.

Preferably, the step of remotely accessing the first information, second information and the association comprises the step of accessing the first information, second information and the association using a device that is remote to the storage means.

Preferably, the first information comprises video and/or audio information, and the second information comprises a status and mode of the transportation device, and fault related data.

Preferably, the first information further comprises security related information.

Preferably, the security related information comprises personal information.

Preferably, the method further comprises the step of interacting with an access control system to obtain the security related information.

Preferably, the security related information comprises an identifier of a person.

Preferably, the step of creating the association further comprises the step of creating the association between the security related information and the video and/or audio information.

Preferably, the transportation device comprises an elevator, an escalator or a moving walkway.

Preferably, the second information comprises a direction, floor position and door status of the elevator.

According to a third aspect of the present system, there is provided a computer program embodying the method according to the first aspect of the present invention.

According to a fourth aspect of the present invention, there is provided a computer readable medium comprising the computer program according to the third aspect of the present invention.

BRIEF DESCRIPTION OF THE FIGURES

Notwithstanding any other embodiments that may fall within the scope of the present invention, an embodiment of the present invention will now be described, by way of example only, with reference to the accompanying figures in which.

AN EMBODIMENT OF THE PRESENT INVENTION

Figure 1:
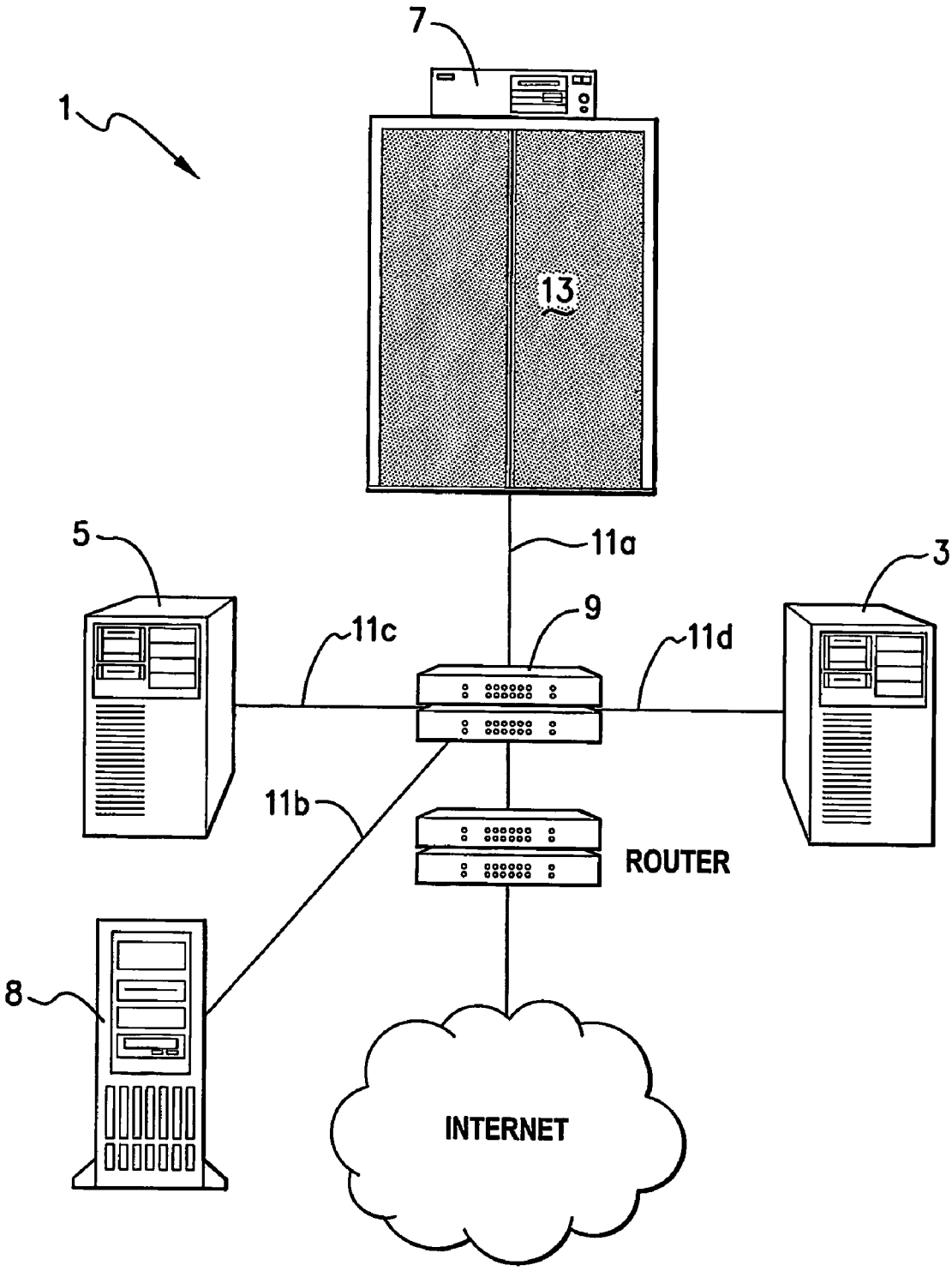
FIG. 1 shows a schematic diagram of a system in accordance with an embodiment of the present invention.
Figure 2:
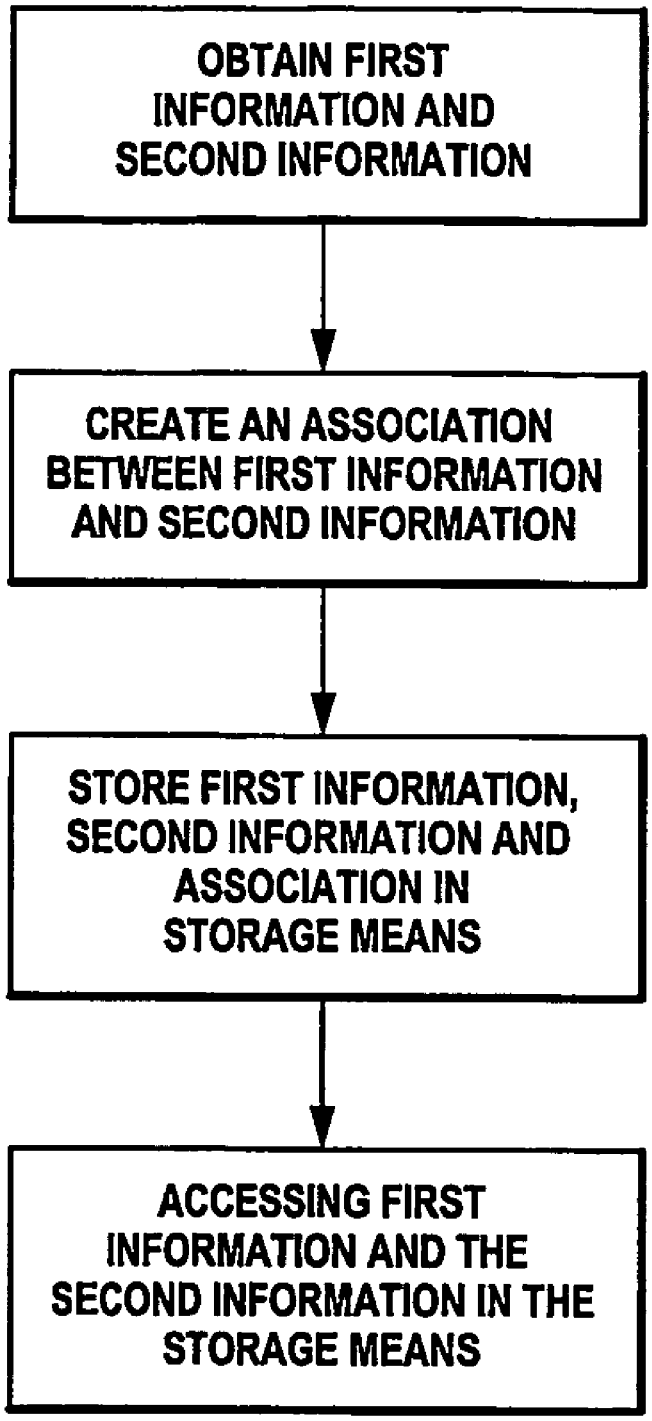
FIG. 2 shows a flow chart of various steps performed by the system of FIG. 1.

As can be seen in FIG. 1, a system 1 according to an embodiment of the present invention comprises: a building server 3; an elevator interface system 5; an elevator client 7; security access and user management system 8; a communication switch 9; and communication links 11.

The elevator client 7 is located on a transportation device in the form of an elevator 13 and is essentially concerned with creating first information related to a person in the elevator 13. The first information comprises video and/or audio information. In order to create the first information, the elevator client 7 comprises a personal computer, a video camera that is connected to the personal computer, and a microphone that is also connected to the personal computer (all of which are not illustrated in FIG. 1). The video camera and the microphone are typical of those used in security systems and are arranged to capture video and audio from the passenger area of the elevator 13. The video and audio signals from the video camera and microphone are forwarded to the personal computer via a video/audio cable. The personal computer comprises a video/audio capture card that processes the video and audio signals from the video camera and microphone to produce a digital version of the video and audio signals. The personal computer is further arranged to place the digital versions of the video and audio signals into a format that can be transmitted over the communication link 11*a* in a reliable manner. In the present embodiment of the invention the format in which the video and audio signals are transmitted over the communication link 11*a* comprises an Ethernet format. The communication link 11*a* is an Ethernet cable strung to the traveling cable attached between the elevator 13 and the elevator motor room (not shown in FIG. 1).

As can be seen in FIG. 1, the communication link 11*a* is connected between the elevator client 7 and the communication switch 9 (which in the present embodiment of the invention is a multi-port Ethernet switch). Consequently, the digital versions of the video and audio signals from the video camera and microphone (which accord with the Ethernet format) are received by the communication switch 9. Given that the digital versions of the video and audio signals are transmitted over the communication link 11*a* according to the Ethernet format, the communication switch 9 is arranged to process information on the communication link 11*a* that is in an Ethernet format.

The first information also comprises security related information such as a security access pass identification number and any associated personal information such as user name, user address, photo of the user, a scan of a business card of the person or a scan of driver's license of the person.

In order to obtain the security related information, the system 1 comprises a security access and user management system 8, which is capable of obtaining the security related information from swipe card access usage records and a corresponding database containing personal information of swipe card users. The security access and user management system 8 is typically located within a dedicated security room in the building (which is not shown in FIG. 1) and is arranged to obtain information about the usage and users of elevator 13 by, for example, a card swipe mechanism or RFID system.

The security access and user management system 8 comprises a communication interface that is capable of arranging the security related information into a format that accords with an Ethernet format. The communication interface is such that it places the security related information onto the communication link 11*b*, which is in the form of an Ethernet cable that extends between the security access and user management system 8 and the communication switch 9.

System 1 also comprises an elevator interface system 5. The elevator interface system 5 is in the form of a PC-based programmable logic controller (which in the present embodiment of the invention is an ADAM 5000 from Advantech Co., Limited) that is used for data acquisition. and which is connected to an elevator control system which controls the operation of the elevator 13. The elevator control system is typically located in the elevator motor room (which is not shown in FIG. 1). The elevator interface system 5 is arranged to create second information comprising a status of the elevator 13. More specifically, the second information comprises details including direction, floor position, door status and mode of the elevator.

The elevator interface system 5 comprises a communication interface that is capable of arranging the second information into a format that accords with an Ethernet format. The communication interface is such that it places the second information onto the communication link 11*c*, which is in the form of an Ethernet cable that extends between the elevator interface system 5 and the communication switch 9.

The communication link 11*c* is connected between the elevator interface system 5 and the communication switch 9. Consequently, when the elevator interface system 5 places the second information on the communication link 11*c* it is received by the communication switch 9.

The elevator client 7, the security access and user management system 8 and the elevator interface system 5 place the first information (audiovisual information and security related information) and second information onto the communication links 11*a*, 11*b* and 11*c*, respectively, in a streaming fashion; that is, the elevator client 7, the security access and user management system 8 and elevator interface system 5 output the information on a continues basis.

The communication switch 9 is arranged such that upon receiving information via the communication links 11*a*, 11*b* and 11*c* (that is, the first information and the second information), it re-directs that information onto communication link 11*d*. The communication link 11*d* is in the form of a cable that supports the Ethernet communication standard. The communication switch 9 places information onto the communication link 11*d* in the Ethernet format. The communication link 11*d* is connected to the building server 3; consequently, any information placed on the communication link 11*d* by the switch 9 will be received by the building server 3. This means that the first information created by the elevator client 7 and the security access and user management system 8, and the second information created by the elevator interface system 5 will ultimately be received by the building server 3 via the communication link 11*d*.

The building server 3 comprises an obtaining means which is arranged to enable the building server 3 to obtain the first information (audiovisual information and security related information) and the second information (elevator status information). Essentially, the obtaining means is in the form of hardware and/or software that is capable of interacting with the communication link 11*d* in order to retrieve the first information and the second information, which was initially placed on the link 11*d* by the communication switch 9. The obtaining means is further arranged such that it supports the Ethernet format so that it can decode the information placed onto the link 11*d* by the switch 9.

The building server 3 also comprises an associating means that is arranged to create an association between the first information and the second information retrieved from the communication link 11*d* by the obtaining means. The associating means is also in the form of hardware and/or software. In order to create the association between the first information and the second information, the associating means essentially marks the first information and the second information with a time and/or date stamp. The first information and the second information are marked with the time and/or date stamp shortly after the information is obtained by the obtaining means. The building server 3 comprises an internal clock (which is periodically synchronised with a standard time service via the Internet), which the associating means uses to get the time and/or date stamp that is used to mark the first information and the second information.

Marking the first information and the second information with a time and/or date stamp provides the advantage of, for example, allowing an entity viewing an image of the passenger component of the elevator 13 (contained in the first information) to readily determine the status of the elevator 13 at an instant when the image was captured. This is achieved by checking for the same or similar time and/or date stamps in the first information and the second information.

In addition to the obtaining means and the associating means, the building server 3 comprises an internal storage means in the form of a database. In the present embodiment, the database is a MySQL database from MySQL AB. The building server 3 uses the storage means to store the first information, second information and the association. The building server 3 stores the information in the storage means in a format that accords with an extensible mark-up language (XML).

It is envisaged that in an alternative embodiment of the present invention, the system 1 would make the first information, second information and the association available in real-time to a call centre before the information (first and second) and the association are placed into the storage means.

The building server 3 comprises an access means that enables an entity to gain access to the storage means in order to access and retrieve the first information, second information and the association. Essentially, the access means is in the form of hardware/software (forming, for example, a web site) that enables the entity to log onto the building server 3 either via a local area network or the Internet and retrieve the first information, second information and the association from the storage means.

Typically, the entity logging onto the building server 3 is, for example, a security monitoring system used by a building manager to monitor the elevator 13. The monitoring system is arranged to present the first information and the second information to the building manager via a computer screen.

It will be appreciated by those skilled in the art that whilst the embodiment of the present invention has been described with reference to an elevator, the present invention has application to other transportation devices such as escalators and moving walkways.

Those skilled in the art will appreciate that the invention described herein is susceptible to variations and modifications other than those specifically described. It should be understood that the invention includes all such variations and modifications which fall within the spirit and scope of the invention.

The claims defining the invention are as follows:

1. A system for forming information pertaining to a transportation device, the system comprising:

obtaining means arranged to obtain first information that is related to a person using the transportation device, the first information comprising one or both of video and audio information captured of the person using the transportation device, and second information about a status of the transportation device;

associating means arranged to create an association between the first information and the second information to thereby form the information pertaining to the transportation device;

storage means arranged to store the first information, second information and association, and access means arranged such that an entity can access the first information, second information and the association stored in the storage means, to search and determine the status of the transport device relative to the one or both of video and audio information captured.

2. The system as claimed in claim 1, wherein the obtaining means is arranged to obtain the first information and the second information from an information capture system that is remote to the obtaining means.

3. The system as claimed in claim 1, wherein the obtaining means comprises a communications interface arranged such that the obtaining means can obtain the first information and the second information from the information capture system.

4. The system as claimed in claim 3, wherein the communication interface is arranged to communicate with the information capture system using Ethernet.

5. The system as claimed in claim 1, wherein the associating means is arranged to create the association by assigning first data to the first information and second data to the second information, wherein the first data and the second data correspond substantially with each other.

6. The system as claimed in claim 5, wherein the first data and the second data each comprise a time date stamp.

7. The system as claimed in claim 1, wherein the storage means comprises a database.

8. The system as claimed in claim 1, wherein the access means is arranged such that the entity can access the first information, second information, and the association from a device remote to the storage means.

9. The system as claimed in claim 8, wherein the access means is arranged to communicate with the device via an Internet.

10. The system as claimed in claim 1, wherein the second information comprises a direction, floor position, door status and mode of the transportation device, and fault related data.

11. The system as claimed in claim 1, wherein the first information further comprises related security information.

12. The system as claimed in claim 11, wherein the security related information comprises personal information.

13. The system as claimed in claim 11 wherein the obtaining means is arranged to obtain the security related information from an access control system.

14. The system as claimed in claim 11, wherein the associating means is further arranged to create an association between the security related information and the video audio information.

15. The system as claimed in claim 1, wherein the transportation device comprises an elevator, an escalator or a moving walkway.

16. The system as claimed in claim 15, wherein the second information comprises a direction, floor position and door status of the elevator.

17. A method of forming information pertaining to a transportation device on a computer system, the method comprising the steps of:

obtaining first information that is related to a person using the transportation device, the first information comprising one or both of video and audio information captured of the person using the transportation device, and second information about a status of the transportation device;

utilizing the computer system to create an association between the first information and the second information to thereby form the information pertaining to the transportation device;

storing in computing memory the first information, the second information and the association, and an entity accessing the first information, second information and the association to search and determine the status of the transport device relative to the one or both of video and audio information captured.

18. The method as claimed in claim 17, wherein the step of obtaining the first information and the second information comprises the step of obtaining the first information and the second information from a remote information capture system.

19. The method as claimed in claim 17, wherein the step of obtaining the first information and the second information comprises the step of using a communications interface to obtain the first information and the second information from the information capture system.

20. The method as claimed in claim 19, wherein the communication interface is arranged to communicate with the information capture system using Ethernet.

21. The method as claimed in any claim 17, wherein the step of creating the association comprises the step of creating the association by assigning first data to the first information and second data to the second information, wherein the first data and the second data correspond substantially with each other.

22. The method as claimed in claim 21, wherein the first data and the second data each comprise a time and/or date stamp.

23. The method as claimed in claim 17, wherein the storage means comprises a computer-readable database.

24. The method as claimed in claim 17, wherein the step of accessing the first information, second information and the association comprises the step of accessing the first information, second information and the association using a device that is remote to the storage means.

25. The method as claimed in claim 17, wherein the second information comprises a status and mode of the transportation device, and fault related data.

26. The method as claimed in claim 17, wherein the first information further comprises security related information.

27. The method as claimed in claim 26, wherein the security related information comprises personal information.

28. The method as claimed in claim 26, further comprising the step of interacting with an access control system to obtain the security related information.

29. The method as claimed in claim 26, wherein the method comprises the step of creating the association between the security related information and the video audio information.

30. The method as claimed in claim 17, wherein the transportation device comprises an elevator, an escalator or a moving walkway.

31. The method as claimed in claim 30, wherein the second information comprises a direction, floor position and door status of the elevator.

32. A computer program embodying the method as claimed in claim 17.

33. A computer readable medium comprising the computer program as claimed in claim 32.

* * * * *